US007377715B2

(12) United States Patent
Kruise

(10) Patent No.: US 7,377,715 B2
(45) Date of Patent: May 27, 2008

(54) TIRE DEFLATION TOOL DELIVERY DEVICE

(76) Inventor: Ronald Lee Kruise, 2822 Clifford St., Harlingen, TX (US) 78550

( * ) Notice: Subject to any disclaimer, the term of this patent is extended or adjusted under 35 U.S.C. 154(b) by 0 days.

(21) Appl. No.: 11/241,945

(22) Filed: Oct. 4, 2005

(65) Prior Publication Data

US 2006/0078379 A1 Apr. 13, 2006

Related U.S. Application Data

(60) Provisional application No. 60/616,867, filed on Oct. 8, 2004.

(51) Int. Cl.
*E01F 13/12* (2006.01)

(52) U.S. Cl. ..... 404/6

(58) Field of Classification Search ..... 404/6
See application file for complete search history.

(56) References Cited

U.S. PATENT DOCUMENTS

| | | | | |
|---|---|---|---|---|
| 5,330,285 | A | 7/1994 | Greves et al. | |
| 5,452,962 | A | 9/1995 | Greves | |
| 5,536,109 | A | 7/1996 | Lowndes | |
| 5,611,408 | A | 3/1997 | Abukhader | |
| 5,820,293 | A | 10/1998 | Groen et al. | |
| 5,839,849 | A | 11/1998 | Pacholok et al. | |
| 6,048,128 | A * | 4/2000 | Jones et al. | 404/6 |
| 6,115,951 | A * | 9/2000 | Jing et al. | 40/610 |
| 6,155,745 | A | 12/2000 | Groen et al. | |
| 6,206,608 | B1 * | 3/2001 | Blevins | 404/6 |
| 6,220,781 | B1 * | 4/2001 | Miller | 404/6 |
| 6,322,285 | B1 * | 11/2001 | Ben | 404/6 |
| 6,409,420 | B1 * | 6/2002 | Horton et al. | 404/6 |
| 6,527,475 | B1 | 3/2003 | Lowrie | |
| 6,551,013 | B1 | 4/2003 | Blair | |
| 6,623,205 | B1 * | 9/2003 | Ramirez | 404/6 |
| 6,758,628 | B1 | 7/2004 | Curry | |
| 7,121,760 | B1 * | 10/2006 | Curry, Jr. | 404/6 |
| 7,210,875 | B1 * | 5/2007 | Christle et al. | 404/6 |
| 2005/0214071 | A1 * | 9/2005 | Collier | 404/6 |

* cited by examiner

*Primary Examiner*—Gary S. Hartmann
(74) *Attorney, Agent, or Firm*—Donald Grant Kelly

(57) ABSTRACT

This tire deflation tool deployment device is designed for use in situations where law enforcement officials desire to stop a vehicle in a chase situation. The device disclosed deposits a spiked deflation tool from beneath a command vehicle into the pathway of a target vehicle so as to puncture a tire of the target vehicle. The device includes a deflation tool storage and release housing. A fabric panel attached at one end to the housing has a second end wrapped about the tool and serves to lower the tool toward the pathway in an even and controlled manner before the tool leaves the fabric panel. From its release from the housing, movement and attitude of the tool are controlled by tether lines interconnecting the tool with the housing and payed out to a given extent limiting the distance the tool is towed behind the command vehicle.

16 Claims, 4 Drawing Sheets

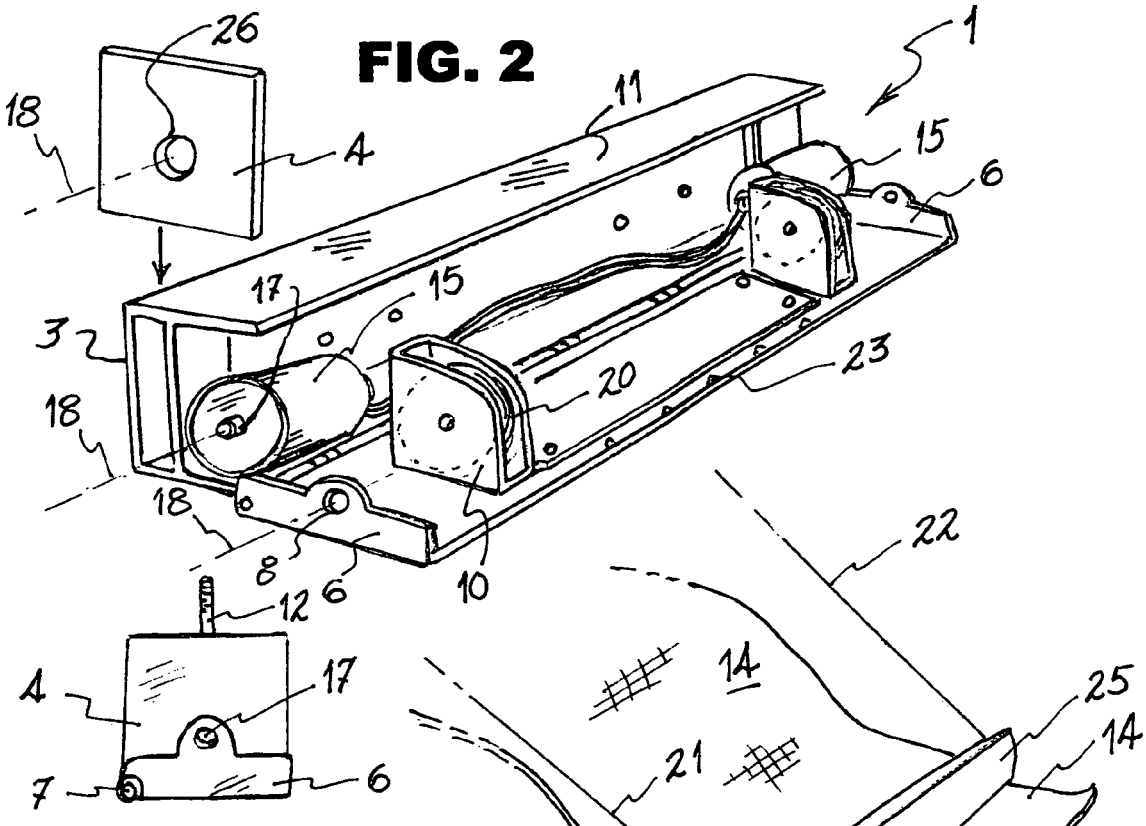
FIG. 2
FIG. 5
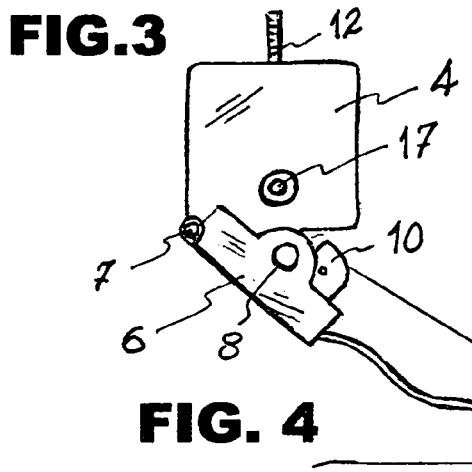
FIG.3
FIG. 4

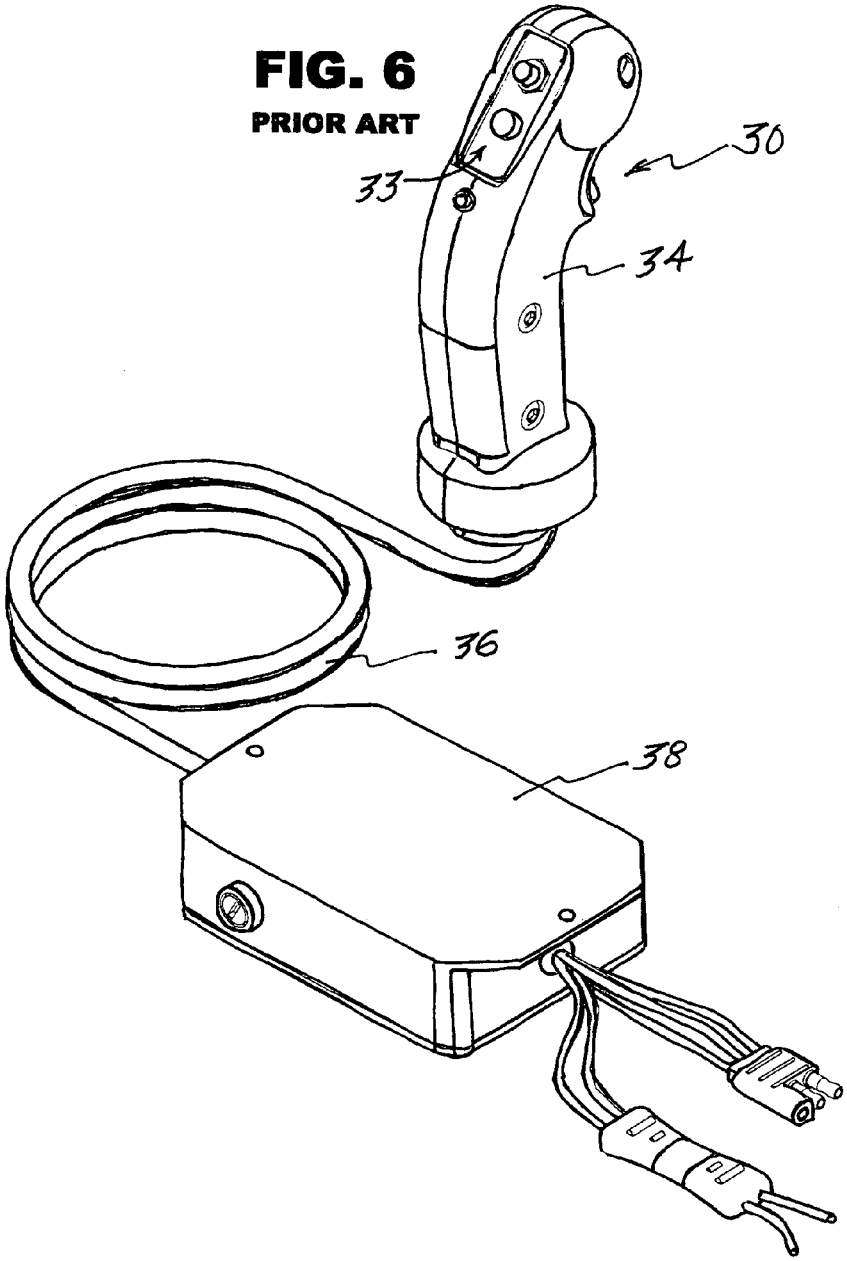
FIG. 6
PRIOR ART
FIG.7
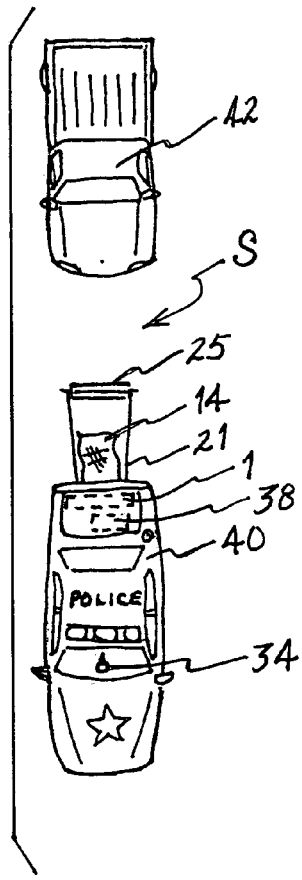

TIRE DEFLATION TOOL DELIVERY DEVICE

REFERENCE TO RELATED APPLICATIONS

The present application claims priority under 35 USC 119(e), of Applicant's Provisional Patent Application Ser. No. 60/616,867 filed Oct. 8, 2004, herein incorporated in its entirety.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. The Field of the Invention

The present invention relates to a system for stopping a fleeing vehicle by causing a tire thereof to deflate by depositing a spiked deflation tool from a chase vehicle into a pathway of said fleeing vehicle to cause puncturing of at least one tire of the fleeing vehicle.

2. Description of Related art

Situations where law enforcement officers are required to give chase to perpetrators have grown to be ubiquitous. Once viewed as the capstone scene in cops and robber cinemas, a number of prime-time television productions now are based solely on this activity. Audiences are drawn to the death-defying antics of crazed, drunken or otherwise desperate criminals weaving in and out of freeway traffic, racing across crowded intersections. Ever as desperate, police officers and sheriffs alike race to keep up in efforts to apprehend the offender before harm is done.

For those involved, this is far from entertainment. Indeed, an increasing number of chase participants and bystanders do not survive; so many in fact that authorities in many jurisdictions have curtailed such chases despite the obviously negative outcome. In more recent times, a number of auto chase alternatives have been developed. Authorities are looking to technology, in the form of tools and mechanisms, to safely stop a fleeing or suspicious vehicle. Many of these tools include tire puncturing implements that are placed, thrown, or released into the vehicle's pathway.

For example Pacholok et al., in U.S. Pat. No. 5,839,849 disclose a spike deployment system that is projected in front of a fleeing vehicle. Similarly, Abukhader's U.S. Pat. No. 5,611,408 would stop a car using hollow spikes that facilitate escaping air from punctured tires. Spike strips, also including a hollow spike design, are deployed by a system presented by Lowndes in U.S. Pat. No. 5,536,109.

A spike belt is disclosed by Blair in U.S. Pat. No. 6,551,013. Blair describes a portable tire deflation device in the form of a band of spring steel 10-12 feet in length. Blair's spike belt is divided into multiple segments wherein each segment has a strip of removably secured, hollow steel spikes, and is designed for a law enforcement officer to deploy across a lane of traffic.

Groen et al., in U.S. Pat. No. 6,155,745, teaches a vehicle tire deflation device to be positioned on a road surface in front of a moving vehicle. The device has a collapsible outer cover which makes it safe for handling prior to its deployment. The cover easily collapses so as not to impede the operation of the device in puncturing tires of the target vehicle. The multi-piece spike design of Groen et al. combines to penetrate the tire surface, subsequently embedding a hollow quill in the tire tread. Thus, the tire deflates at a controlled rate rather than a dangerous blowout.

Easily carried in the trunk of a police vehicle, the Groen et al. device has an optional mating connector configured so as to rigidly connect two or more deflation devices together for broader road coverage. A rolling tire embeds a hollow, puncturing quill which remains in the tire. Alternative designs for a tire penetration device including puncturing quills of the hollow type are described in Groen et al., in U.S. Pat. No. 5,820,293. Greves and Greves et al., respectively in U.S. Pat. No. 5,452,962 and No. 5,330,285 illustrate further embodiments tire puncturing implements of note. The above-discussed patents to Groen et al., Greves and Greves et al. patents present deflation tool technology assigned to Stop Stick, Inc. of Lawrenceville, Ind.

In U.S. Pat. No. 6,527,475, Lowrie illustrates a system mounted to the underside of a vehicle behind the rear tires thereof similar to the location of the present invention device housing as will be described herein. The Lowrie system acts to eject a collapsed tire deflation device by means of a compressed gas propulsion source. A set of control switches is mounted inside the vehicle near the operator so as to control the ejection. The ejected deflation device remains attached to the housing via a tether line.

Curry, in U.S. Pat. No. 6,758,628, illustrates a method and apparatus for launching a base member in the form of a spiked strip directly from under the rear of a lead vehicle and onto a roadway in front of a trailing target. The spiked strip causes deflation of the tires of the trailing vehicle. The spiked strip includes a plurality of tire piercing spikes projecting in a single direction. Illustrated is a trapezoidal housing with a bottom plate having said spiked strip affixed thereto. The plate is designed to drop onto the roadway when triggered by the operator of the lead vehicle. A mechanical and/or electromechanical latching device is employed by Curry for holding and releasing a trailing edge of the bottom plate.

Curry's spiked strip is illustrated as affixed to the bottom plate such that when the plate engages the road surface there is no possibility of the spiked strip "turning turtle" to an ineffective position. Although not illustrated, Curry suggests that the bottom plate may in some way be hinged to a forward lip so that an unattached spiked strip would be allowed to slide down the bottom plate which would serve as a launching ramp for the spiked strip. In this latter embodiment, the descent of the spiked strip would appear to be uncontrolled as to tumbling or disorientation relative to a targeted vehicle tire.

While each of the above-described devices and methods has its merits, none is completely satisfactory. Some in fact even pose considerable risks to the law enforcement officers who are assigned to deploy them. These devices place not only the officers in danger but also endanger innocent drivers and bystanders. The present inventive system effectively resolves the shortcomings and inadequacies of the prior art in satisfying a long felt need.

BRIEF SUMMARY OF THE INVENTION

The invention presented herein is specifically configured to provide for a controlled orientation and deployment of a tire puncturing device such that the device will move relatively smoothly out of a storage position and onto a road surface, and subsequently be controlled in its movement relative to an oncoming, trailing target vehicle.

A housing container is mounted under a rear portion of a chase vehicle, henceforth referred to as the command vehicle. Within the container is stored a tire puncturing tool having a generally elongated base with multiple tool sides. The elongated base further includes at least one spike affixed thereto, said at least one spike extending outwardly from the base in a direction opposite to at least one of the multiple tool sides. This configuration ensures that, as the tool base rests (or slides, as will be described below) on one of its tool sides, an outwardly extending spike will be in position to puncture the tire of a fleeing vehicle.

The tire puncturing tool may employ multiple hollow spikes designed to pierce tough tire treads and pierce deeply enough into a tire such that deflation occurs. Each spike is of the well-known type that becomes individually embedded within the target tire of the fleeing vehicle, henceforth referred to as the target vehicle. The embedded hollow spike ensures continued and controlled deflation of the target vehicle tire.

The tire puncturing device may take any of a variety of popular forms well known in the art, with minor modifications as will be defined. For simplicity, the device will be referred to herebelow as a drop stick. An electromechanical trigger mechanism is operated from the command vehicle cab area, and acts to unlatch and release a hinged section or wall of the housing container. Descent, movement and attitude of the drop stick are controlled by a delivery device in the form of a flexible fabric member which may be synthetic or natural in construction.

The drop stick is enveloped within said fabric in such as way that the fabric is wrapped around the drop stick and both are stored within the housing container. Additionally, a tether line is affixed to each end of the drop stick and anchored suitably at or near the housing container such that it may be spent out as required as the drop stick leaves the housing container and descends to the roadway, and subsequently (relatively) approaches the target vehicle. The two tether lines control the orientation and extent of the deployment.

BRIEF DESCRIPTION OF THE DRAWINGS

The invention will be best understood by reference to the following detailed description of an illustrative embodiment when read in conjunction with the accompanying drawings, wherein:

FIG. 2 is a second perspective view of elements of the tire deflation tool delivery device with portions removed, and which is illustrated as having been tilted back on it's side for a clearer viewing;

FIG. 3 illustrates an end view of elements of the tire deflation tool delivery device in a closed mode;

FIG. 4 illustrates an end view of elements of the tire deflation tool delivery device in an open, delivery mode;

FIG. 5 illustrates a perspective view of a detailed portion of the delivery device in delivery mode;

FIG. 6 is a perspective view of a control triggering mechanism illustrated as PRIOR ART;

FIG. 7 is a plan view of a chase situation where the tire deflation tool is being deployed in controlled mode;

DETAILED DESCRIPTION OF THE INVENTION

Details of the present invention are provided for purpose of illustration and disclosure, but are not intended as exhaustive or limited to the invention in the form disclosed. Many modifications and variations of the inventive system disclosed will be apparent to those of ordinary skill in the art. The presented embodiments are chosen and described in order to best explain the principles of the invention and its practical application to enable others of ordinary skill in the art to understand the invention for various embodiments with various modifications as are suited to the particular use contemplated.

Figure 1:
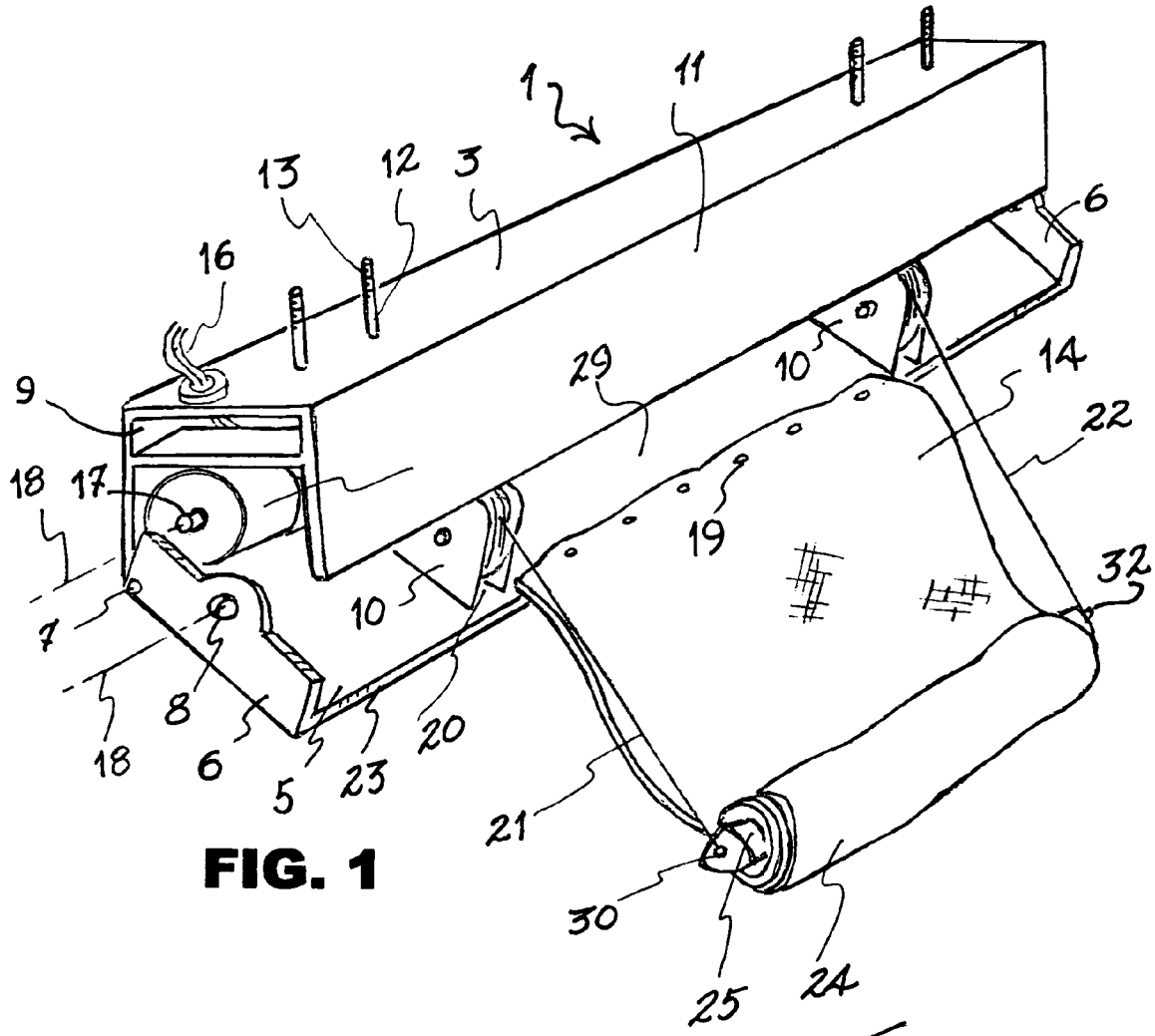
FIG. 1 is a perspective view of elements of the tire deflation tool delivery device, showing the delivery device for a tire deflation tool.

Referring now to FIG. 1, a perspective view is presented to illustrate a system for stopping fleeing vehicles, said system includes a release device 1 having a number of components. One component generally takes the form of generally rectangular container housing for temporary storage of a spiked tire deflation tool. This container housing is defined as having a plurality of walls, further defining interior space for temporarily securing said deflation tool in its stored position. A first one of said walls includes a pivoted connection relative to a second one of said walls such that said one of said walls affords an exit opening from said container housing.

In this embodiment said one of said plurality of walls is viewed as bottom wall 5 shown opposite a top wall 3. Said second of said plurality of walls is viewed as front wall 9. Wall 5 has a forward edge at pin 7 (interconnecting wall 5 at said front wall 9) and rearward edge 23, and is mounted so as to be movable from a closed position to an open position, respectively, for retaining and releasing the deflation tool.

In this case, for example, wall 5 is pivoted at pin 7 at or near where bottom wall 5 and end walls 4 join front wall 9. Rear wall 11 generally opposes front wall 9 and adapted to be mounted so as to be just within the confines of a rear bumper 46 of the command vehicle (see FIG. 8). When pivoted, wall 5 forms an exit opening defined by rearward edge 23 thereof and rear wall 11.

The container housing walls 3, 4, 5, 9 and 11 may be fabricated in a number of well-know ways, and from any of a variety of suitable materials. For purposes of illustration only, the container housing is shown with end walls 4 removed. As further shown in FIGS. 1 and 1A, deflation tool delivery device 1 includes a space 29 defined by walls 3, 11, 9, and 5. Such space 29 is allocated for temporary storage of deflation tool 25 along with its layered fabric panel wrap 24, as will be described below.

The container housing may, for example, be constructed of cast aluminum. Alternatively, the container housing can be formed of sheet aluminum or steel, in panel segments bonded together as by rivets, spot welding and so forth. Portions of the container housing may also be formed of a single, pre-cut metal pattern and suitably deformed, folded or forged to form a shell to which a hinged panel may be added.

High-impact plastic could also be employed in fabricating any or most all of the components of the release device, again by unitary molding or assembling prefabricated panels. It is important however that the device be considerably durable since it will be mounted on the undercarriage of a command vehicle to be frequently driven over a range of road conditions and operating circumstances as might be imagined in car chases of the type noted above.

Connectors in the form of paced lugs 12 are affixed to the top wall 3 for the purpose of mounting the release device 1 to the undercarriage of a law enforcement command vehicle. Typically, as is well-known in the art, automobile components are attached to a vehicle undercarriage or frame by use of pairs of lugs 12 with distal portions thereof threaded as at 13 for receipt of clamps (not shown) and threaded nuts (not shown). While lugs 12 are disclosed herein, it will be apparent to one skilled in the art that any of a variety of fastening techniques could be employed without departing from the spirit of the invention claimed.

Within release device 1 is housed at least one movable latch mechanism for temporarily latching said movable wall 5 in said closed position, and thus serving as a first restraining member, keeping said deflation tool 25 within said housing container. Said latch mechanism is shown, for example, to include a pair of solenoid units 15 each with a plunger 17 acting as an electronically controlled latch.

The plunger 17 serves to hold bottom wall 5 in place during deflation tool storage. At each end of the bottom wall 5 is an extension 6 wherein is defined a latch receiving portion in the form of a through-hole 8 shaped and adapted to receive plunger 17. (Note that extension 6 can be an integral portion of wall 5, or a separate annular element such as a standard washer affixed thereto, as by welding. Wiring 16 is shown entering top wall 3 and leading to solenoid units 15, for the purpose of carrying power and control signals to said solenoid units 15.

Wiring 16 is interconnected to a control system or electronic brain 38 selected from among a variety of systems existing within the prior art, as will be described below. In a first mode, plunger 17 extends into through-hole 8 (and through a corresponding through-hole shown formed in end-plate 4 illustrated in FIG. 4). In a second mode which would be a "drop command" mode, the solenoid is signaled to retract plunger 17, permitting bottom wall 5 to open.

It should be apparent that the release device 1 could be operated by a single solenoid unit 15 cooperating with only one extension 6, rather than requiring an opposed pair of solenoid units 15 and associated extensions 6. Also, a single solenoid unit 15 could be mechanically deployed to unlatch an extension located elsewhere on bottom wall 15 than presently shown. In considering such options, however, it is important to keep in mind that stability and dependability are key considerations.

Additionally, upon unlatching action of plunger 17 virtually instant opening of wall 5 may be ensured by the optional addition of a simple leaf spring element of conventional design. Such a spring (not shown) would be affixed within a stationary wall, e.g., top wall 3, so as to be biased against an interior surface of a hinged wall, e.g., bottom wall 5. Once unlatched, the biased hinged wall will open quickly regardless of its interior load. This would be particularly useful where a wall other than bottom wall 5 is employed as a hinged exit wall, in a different orientation of the release device 1, a modification that would not depart from the spirit and scope of the present invention.

Fixedly attached only at 19 along rearward or trailing edge 23 of bottom wall 5 is a generally flexible fabric panel 14 serving as a secondary drop stick restraining member. Panel 14 may comprise a rug-like woven textile, a synthetic plastic sheet material, durable canvas, rubber sheet material, ballistic nylon, or the like; or it may be a combination of two or more of such materials. Panel 14 is elongated in form and includes a first end where it is attached to bottom wall 5 at 19, along the exit opening formed at rearward edge 23 of wall 5. Panel 14 further includes a second end free of fixed attachment and confiqured to form a furled wrap, and to enfold said spiked tire deflation tool 25 within said furled wrap.

In use, the fabric panel 14 will have a first position and a second position. In its first position, the fabric panel 14 is furled and stored within an interior space 29. Within furled fabric panel 14 is a drop stick 25 enfolded or wrapped for temporary storage within said furled panel. In its second position, said fabric panel is unfurled and extends from its attachment at 19 adjacent to the exit opening, and outside said container housing toward a pathway of a target vehicle.

The fabric panel second end unfurls, and serves to cradle and steady the drop stick 25 in descent toward a pavement surface where the drop stick settles in position to address an approaching tire of the fleeing, or target, vehicle. Thus, drop stick 25 arrives at the roadway surface with a proper attitude, that is, a position that is generally perpendicular to the pathway of the approaching target. Without this substantial improvement, the drop stick 25 would tumble from its housing and experience a chaotically bouncing impact along the roadway.

The attaching elements 19 holding said first end of the fabric panel 14 may be metal screws, clamps, clips or the like, or combinations thereof, all of which are well-known to those skilled in the fastener art. It is important however, that the attachment be robust and trustworthy given the key role the panel 14 will play.

Spaced along bottom wall 5 (FIG. 1) or front wall 9 (FIG. 1A) and extending adjacent each end of the stored deflation tool or drop stick 25 are a pair of line boxes, 10. Line boxes 10 serve to define said space 29 wherein said deflation tool is snuggly supported so as to avoid rattles or disorientation from an action-ready position. These line boxes 10 contain tether lines 21, 22. Each said tether line has a first end, a second end, and a predetermined extent, and is anchored at said first end to one of said walls. This anchored connection may (optionally) include tension reels or spools 20, or a simple fixed connection permitting unrestricted withdrawal or paying out of the tether lines.

Figure 1A:
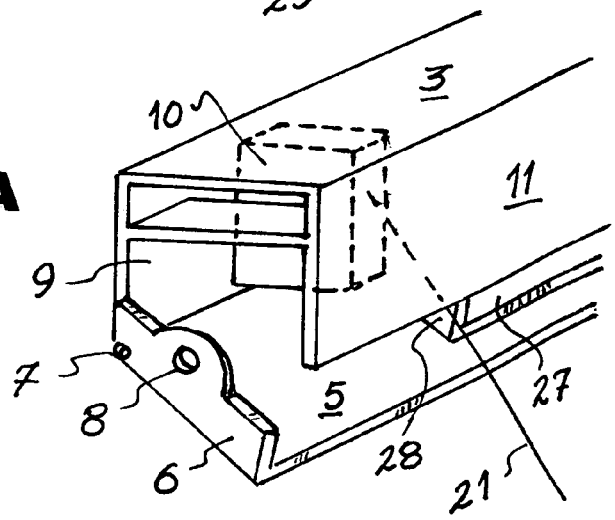
FIG. 1A, similar to FIG. 1, is a perspective of the tire deflation tool delivery device wherein an alternative location is depicted for tether line storage line boxes.

Note that FIG. 1A is a partial view showing only one of a pair of line boxes 10 mounted on front wall 9. In this optional embodiment, a U-shaped angle plate 27 is affixed to bottom wall 5 such that upwardly extended arms 28 of said angle plate 27 serve as brackets to directly engage ends of the wrapped, spiked deflation tool 25. Note that a portion of one such arm 28 is viewed in FIG. 1A. Performance of line boxes 10 is essentially the same from either location.

A second, extended end of each of said tether lines 21, 22 is affixed or configured to attach to a respective end connector 30, 32 of the drop stick deflation tool 25. Optionally, reels 20 may be provided within line boxes 10 so as to control the feed or paying out of tether lines 21, 22. Such reels include spring loaded recoil mechanisms affording a slight controlling tension to the tether lines 21, 22 during the deployment of the deflation tool 25.

Such spring mechanisms are well known in the art and are available commercially from Vulcan Spring & Manufacturing Company based in Telford, Pa. This recoil spring feature affords a stabilized feed to the moving drop stick 25 as it is payed out from the unfurling panel 14 and along the roadway surface toward a target vehicle. The mechanisms further facilitate rewinding of tether lines 21, 22 on return to line boxes 10.

Tether lines 21, 22 have a predetermined length or extent to control the distance to which spiked deflation tool 25 will be permitted to deploy. Said predetermined length may, noted only by way of example, be in the general range of 10 to 20 feet. These tether lines 21, 22 follow the drop stick 25 in its descent from said housing container so as to control the attitude and extent of movement of said drop stick 25 away from the command vehicle 40.

As illustrated in FIG. 2, for sake of clarity, the delivery device housing container 1 has been tipped 90-degrees onto wall 9. This view offers a clearer perspective of line boxes 10 and reels 20 for tethers 21, 22. Additionally, end wall 4 is shown in exploded position just above its normal location at one end of walls 9, 3, 11. A duplicate end wall 4 (not shown) would, of course, close the opening (shown for illustrative effect only) at a second end of walls 9, 3, 11 When in place, end walls 4 would be partially covered or engaged by extensions 6 of bottom wall 5.

Wall 4 is depicted as defining a through-hole 26. Through-hole 26, plunger 17 and through-hole 8 (in extension 6) share a common centerline 18 (see FIG. 1 and FIG. 2) when aligned in latching position. Again, these elements are duplicated at said second end.

FIGS. 3 and 4 illustrate an end view of the delivery device 1 oriented such that lugs 12 are generally vertical, and bottom wall 5 is hinged at pin 7. With plunger 17 extended into latching position as depicted in FIG. 3, extension 6 and wall 5 are captured in place, awaiting a release deployment command. Upon activation, as depicted in FIG. 4, plunger 17 retracts and the deflation tool 25 with its fabric panel wrap is deposited downwardly in a controlled or cradled manner as panel 14 quickly unfurls.

Fabric panel 14 is of such length as to remain with the descending deflation tool 25 until roadway deposit is effected. Tether 21 (and companion tether 22, not shown in this view) extends from its associated line box 10 to control the attitude of the deflation tool 25 as it approaches the target vehicle tire.

FIG. 5 is another partial view of the deflation tool 25 as it moves off of the fabric panel 14. In both FIG. 4 and FIG. 5, the fabric panel 14 has just relaxed its coiled contact with tire deflation tool 25 as said tool 25 approaches direct roadway contact. As noted above, each said tether line 10 has a length of a determined extent, and follows said deflation tool in its descent from said housing and limits the deployment thereof (as it trails behind said command vehicle).

The tire deflation tool 25 may take a number of shapes or designs. Though not intended as limiting the scope of the present invention described and claimed, the tool 25 Illustrated herein is essentially triangular in cross section. Further tool 25 is shown as elongated and includes an array of spikes or quills. This triangular configuration permits the deflation tool 25 to assume a relatively stable position when settled on the roadway surface.

The pointed spikes affixed to deflation tool 25 may be covered by a collapsible outer cover that protects the hands of users prior to deployment. When engaged by a target vehicle tire, the cover collapses such that spikes penetrate the tire and a hollow quill is embedded therein to deflate the tire at a controlled rate so as to avoid a dangerous blowout. This form of deflation tool is commercially as the STOP STICK®, and is generally reflected in one or more of the above-noted patents assigned to Stop Stick, Ltd. of Harrison, Ohio.

"Eased" or "cradled" descent of the deflation tool 25 avoids the chaotic tumbling action common in prior systems of this type. Deflation tools simply dropped or ejected from a rapidly moving command vehicle generally strike the hard payment with an uncontrolled bounce, resulting in improper orientation or attitude of the dropped device. The tether lines 21, 22 serve to control the attitude or approach of the deflation tool as it (relatively) closes on the target vehicle tire.

These lines 21, 22 further define the extent to which the deflation tool 25 trails the command vehicle. Bouncing spiked devices can cross into other lanes, smashing windshields and damaging paint and tires of other vehicles, either those of passers-by or those of other law enforcement officers involved in a chase.

FIG. 6 illustrates a manually operated command system 30 in the form of a manual trigger unit connected to an electronic controller unit, well known in the prior art, and shown here with a handgrip 34. Communications wiring 36 interconnects the command system 30 with a "brain" or electronic controller 38. Output/input cables lead to the deflation tool delivery device 1, sending commands to solenoids 15 to direct unlatching action and receiving feedback that the tire deflation device 25 has been unloaded or deposited. While a variety of command systems are available for this activity, the system illustrated in FIG. 6 (Prior Art) is commercially available from Scorpion Technologies, Inc. based in Kamloops, BC, Canada.

Wiring 36 runs from the command vehicle cab to the vehicle trunk space where the electronic controller 38 is located, and from there to key components of the delivery device mounted within (or just ahead of) a rear bumper 46 of the command vehicle 40. Handgrip 34 has two buttons generally designated 33, one of which acts to arm, or "ready," the deflation tool deliver device 1, preparing it to be opened. When armed, an electronic buzzer sounds intermittently. Engaging the second button activates the delivery device 1 setting it into immediate action. In this mode, a steady electronic buzzer sound is initiated alerting the operator of the command vehicle to the release of the tire deflation tool 25 onto the roadway.

A typical confrontation situation "S" is illustrated in FIG. 7, where a target vehicle 42, presumably driven by a suspect unwilling to pull over during a pursuit, is about to be stopped by a tire deflation tool 25 deployed in accordance with the present invention. Command vehicle 40 includes handgrip 34 which operates the electronic brain 38 located in the command vehicle trunk. The delivery device 1 is illustrated as just having deployed the deflation tool 25 via flexible fabric panel 14. Leaving the fabric panel 14, tool 25 continues toward the target vehicle 42, as shown, and takes up a position defined by the extent of tether lines 21, 22.

Figure 8:
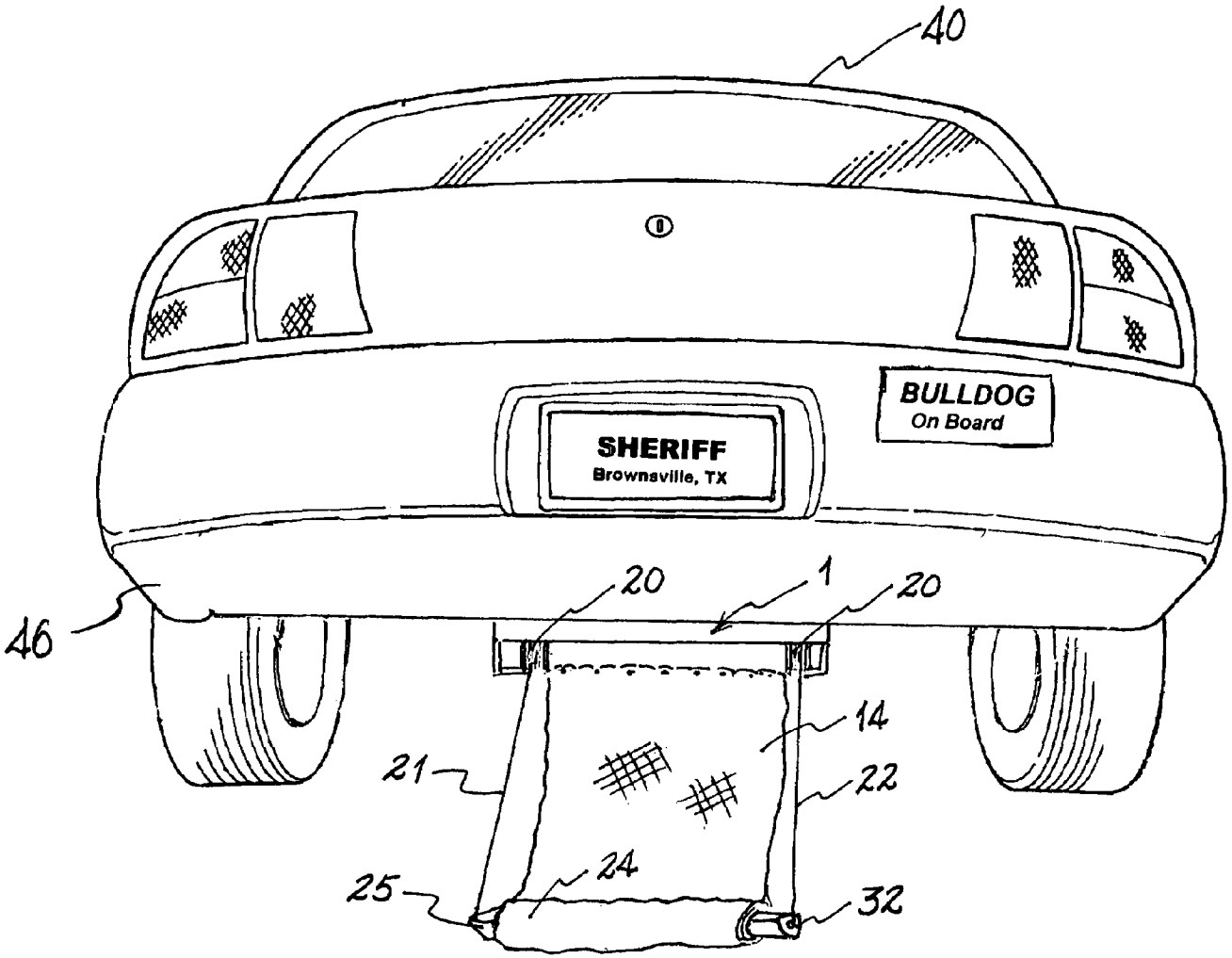
FIG. 8 is a perspective view of the rear of a law enforcement command vehicle of the type illustrated in the Lowrie patent (discussed above), but wherein the deflation tool is being deployed by Applicant's unique system.

FIG. 8 offers an expanded view of the tool 25 just prior to leaving the fabric panel 14. Delivery device 1 is shown as installed just ahead of rear bumper 46 (affixed to the undercarriage of command vehicle 40 generally similar to that illustrated in U.S. Pat. No. 6,527,475 to Lowrie discussed above). Note that FIG. 8 illustrates where tethers 21, 22 are fed or payed out from spools or reels 20 in line boxes 10.

Again, such line boxes may be mounted on bottom wall 5 as shown in FIG. 1, on front wall 9 as indicated in FIG. 1A, or elsewhere in housing container 1, or on the command vehicle 40 as may be convenient. Tether lines 21, 22 must be strong enough to handle the stress and sudden tension. In this instance, the lines are typically in the 90-150 lb. range.

It is important to note that, while the present invention is illustrated as utilizing a hinged bottom wall 5, alternative orientations of the device and/or minor design modifications can utilize a different wall, e.g., trailing wall 11. Though not specifically illustrated, this is well within the scope and spirit of the present invention. The ejection assistance of a leaf (or other form on spring may be employed to ensure that the deflation tool and its fabric wrap are efficiently and effectively deployed.

This invention thus allows law enforcement officers to direct deployment of tire deflation tools from the interior of the command vehicle. Importantly, an officer may do so reasonably quickly and accurately, without having to leave the safety of the command vehicle to place herself/himself in front of a fleeing vehicle in a risky attempt to manually deploy the tire deflation tool. The present invention further presents vast improvement of prior attempts to drop or eject spiked implements from a vehicle onto a roadway surface in a safe effective way. Deposit of the deflation tools can be made discretely and at slower rates of speed before a pursuit escalates to dangerous speeds.

Although various features of the present invention have been described in the foregoing detailed description and illustrated in the accompanying drawings, it will be understood that the invention is not limited to the embodiments disclosed, but may assume numerous arrangements, rearrangements, modifications, and substitutions without departing from the spirit of the invention.

I claim:

1. In a tire deflation tool deployment device for depositing a spiked deflation tool from a command vehicle into the pathway of a moving target vehicle so as to cause puncturing of at least one tire of said target vehicle, said deployment device including a housing defining a first deflation tool restraining member for temporary storage of said deflation tool, said housing further including a wall movable from a closed position to an open position respectively for retaining and releasing said deflation tool, and said housing having a latch mechanism for temporarily latching said wall in said closed position, the improvement comprising:

a secondary deflation tool restraining member having a first end and a second end;

said secondary restraining member fixedly attached only at said first end thereof to said movable wall;

said second end of said secondary restraining member free of fixed attachment and configured to wrap about said deflation tool;

whereby, upon release of said latch mechanism and movement of said wall to its open position, said deflation tool wrapped within the second end of said secondary restraining member is eased from said housing in a manner controlled by said secondary restraining member.

2. The deflation tool deployment device of claim 1 wherein the improvement further comprises:

said secondary restraining member is in the form of an elongated fabric panel, said fabric panel fixed only at its first end along an edge of said movable wall.

3. The deflation tool deployment device of claim 2 wherein the improvement further comprises:

said housing including at least one line box fixed thereto;

at least one tether line having a first end, a second end, and a predetermined extent;

said first end of said tether line attached at said line box, and said second end of said tether line configured to extend from said line box and to connect to said deflation tool; whereby said tether line follows said deflation tool in its descent from said housing and limits the deployment thereof to said predetermined extent.

4. The deflation tool deployment device of claim 3, further defined by:

a pair of tether line boxes, including said at least one line box and a second line box, both said boxes affixed to said housing;

a pair of tether lines including said at least one tether line and a second tether line, each said tether line having a first and second end, said first end of said at least one tether line attached at said first box;

said first end of said second tether line attached at said second box;

said second ends of said first and second tether lines are configured to attach to respective ends of said deflation tool;

whereby said first and second tether lines follow said deflation tool in its descent from said housing and control the movement and extent of said deflation tool into the pathway of said target vehicle.

5. A tire deflation tool deployment device for depositing a spiked deflation tool from a command vehicle into a pathway of a moving target vehicle so as to cause puncturing of at least one tire of said target vehicle, said device including:

a container housing including a plurality of walls defining interior space for temporarily securing said deflation tool in a stored position;

said container housing having at least one connector for mounting said container housing to said command vehicle;

a first one of said plurality of walls having a pivoted connection to a second one of said plurality of walls so as to define an exit from said container housing; a fabric panel having at least a first and second edge, said fabric panel fixedly connected only at said first edge to at least one of said walls adjacent said exit and its second edge free of fixed attachment configured to enfold said deflation tool in said stored position;

at least one movable latch mechanism having a first and second latch position;

said first one of said plurality of walls having a latch engagement portion configured so as to be engaged by said at least one movable latch mechanism in said first latch position and to be disengaged from said at least one movable latch mechanism in said second latch position so as to permit controlled descent of the deflation tool as said fabric panel unfolds;

whereby said fabric panel fully unfolds to ease said deflation tool into the pathway of said target vehicle at said second edge of said fabric panel.

6. The tire deflation tool deployment device of claim 5 further defined by:

said first one of said plurality of walls including a latch receiving portion thereof configured for engagement of said at least one movable latch mechanism in said first latch position;

said at least one movable latch mechanism is further defined as a solenoid having a reciprocal plunger adapted to be engaged with said latch receiving portion of said first one of said plurality of walls.

7. The tire deflation tool deployment device of claim 6 wherein said latch receiving portion of said first one of said plurality of walls includes a wall surface defining a through hole.

8. The tire deflation tool deployment device of claim 6 further defined by:

an electronic control unit interconnected to said at least one movable latch mechanism;

a manual trigger unit interconnected to said electronic control unit;

whereby an operator of said command vehicle may activate said electronic control unit to activate said at least one movable latch mechanism so as to discharge said deflation tool and fabric panel.

9. The tire deflation tool deployment device of claim 5, wherein said device is further defined as including:

at least one line box located within said container housing interior;

at least one tether line attached at said line box and configured to connect to at least one end of said tire deflation tool;

whereby said at least one tether line acts to control movement of said deflation tool toward said target vehicle.

10. The tire deflation tool deployment device of claim 9 further defined as including:

a pair of line boxes, including said at least one line box and a second line box, both said line boxes located within said container housing interior;

a pair of tether lines, including said at least one tether line and a second tether line each said line attached to one of said pair of line boxes and configured to attach to a separate end of said tire deflation tool;

whereby said movement of said deflation tool with relation to said target vehicle is stabilized.

11. The tire deflation tool deployment device of claim 5 further defined by:

one of said plurality of walls is a top wall;

said at least one connector is located on said top wall and configured to connectively engage with an undercarriage of said command vehicle.

12. The tire deflation tool deployment device of claim 11 further defined by:

said first one of said plurality of walls is a bottom wall having a forward and a rearward edge;

a second one of said plurality of walls is a front wall;

said bottom wall has a pivot connection adjacent said front wall.

13. The tire deflation tool deployment device of claim 12 further defined by:

said first end of said fabric panel being connected to said bottom wall adjacent said rearward edge thereof.

14. A system for stopping a fleeing vehicle by causing a tire thereof to deflate by depositing a deflation tool from a chase vehicle into a pathway of said fleeing vehicle so as to cause puncturing of at least one tire of said second vehicle, said system including:

a tire deflation tool having an elongated base and multiple tool sides said elongated base further including at least one spike affixed thereto, said at least one spike extending outwardly from said base in a direction opposite to at least one of said multiple tool sides;

a container housing including a plurality of walls defining an interior space for temporarily storing said tire deflation tool;

said plurality of walls including a pair of end walls;

said container housing having at least one connector for mounting said container housing to an undercarriage of said first vehicle, said at least one connector being attached to one of said plurality of walls;

a first one of said plurality of walls having a pivoted connection at each of said pair of end walls, and juxtaposed to another of said plurality of walls so as to define an exit opening from said container housing;

a latch mechanism temporarily holding said first one of said plurality of walls in a closed position a control unit for releasing said latch mechanism;

said system further including an elongated fabric panel member having a first and second edge;

said fabric panel first edge connected to said first one of said plurality of walls adjacent said exit opening;

said fabric panel member having a first and a second position;

said fabric panel, in a first position, is furled and stored within said interior space;

in a second position, said fabric panel is unfurled and extended through said exit opening and outside said container housing;

whereby said tire deflation tool may be stored within said furled fabric panel member in said first position and, upon its release, controlled in its descent as said fabric panel unfurls so as to place said deflation tool base on one of its multiple tool sides with said at least one spike extending outwardly therefrom.

15. The tire deflation tool deployment device of claim 14 further defined by:

said latch mechanism includes at least one electrically controlled solenoid unit said solenoid having a reciprocal plunger adapted to lock said at least one of said plurality of walls in a closed position;

whereby said exit opening is closed so as to maintain said tire deflation tool and said furled fabric panel in stored position.

16. The tire deflation tool deployment device of claim 15, further including:

a pair of tether line boxes, including a first and second box affixed to said housing;

a first tether line having a first and second end, wherein said first end of said first tether line is attached at said first box;

a second tether line having a first and second end, wherein said first end of said second tether line is attached at said second box;

said second ends of said first and second tether lines are attached to respective ends of said deflation tool;

whereby said tether lines follow said deflation tool in its descent from said housing so as to control the attitude and extent of movement of said deflation tool into the pathway of said target vehicle.

* * * * *